United States Patent [19]

Harlan et al.

[11] Patent Number: 5,067,717

[45] Date of Patent: Nov. 26, 1991

[54] GOLFER'S SWING ANALYSIS DEVICE

[76] Inventors: Thomas A. Harlan, No. 16 Hightrail Way, Austin, Tex. 78738; Joseph F. Long, 1335 Lost Creek Blvd., Austin, Tex. 78746

[21] Appl. No.: 611,683

[22] Filed: Nov. 7, 1990

[51] Int. Cl.[5] ..... A63B 69/36

[52] U.S. Cl. ..... 273/183 B; 273/187 R

[58] Field of Search ..... 273/183 B, 183 E, 183 A, 273/187 R, 187 A, 187 B; 340/573

[56] References Cited

U.S. PATENT DOCUMENTS 3,169,022 2/1965 Kretsinger ..... 273/183 B 3,707,291 12/1972 Tredway ..... 273/183 B 4,493,328 1/1985 Saito ..... 273/183 B X 4,971,325 11/1990 Lipps ..... 273/183 B

*Primary Examiner*—George J. Marlo

*Attorney, Agent, or Firm*—Joseph F. Long

[57] ABSTRACT

This repeatable golf swing teaching device tracks real time movement of the forearm, the upper part of the leg and the head of a golfer during a swing using a light gun fixedly attached to each member with light sensors on a base and also an upright panel to indicate path of movement. When a desired swing path is achieved the paths may be locked in a computer and the desired swing path thereafter compared with subsequent swings with an alarm activated as a subsequent swing deviates from the desired swing path.

4 Claims, 2 Drawing Sheets

GOLFER'S SWING ANALYSIS DEVICE

BACKGROUND

Golf is a sport that has existed for more than a half of century in almost its present form. It is, however, still one of the faster growing sports, possibly because of all the varied possibilities for exercise, socializing, conducting business, etc. At any rate, a great many players are willing to pay a golf pro to teach them how to improve their game. From study of many players actual in-play motion the professional trainers would agree that practice enough to achieve a repeatable swing is necessary. Further, the pros have amply demonstrated that positioning the body, positioning the hands, shifting weight and many other interrelated factors may affect just how and where the ball travels after club impact.

The device of this invention is aimed at determining reproducibility of the path of the club upon backswing and downswing to impact the ball and reproducibility of body movement. These are accomplished by determining path of movement of a forearm, movement of the upper part of the leg and of the head of the person using the device by using a first light gun similar to a flashlight attached to the head, a second light gun attached to the forearm and a third attached to the upper part of the right leg (for a right handed golfer). Light from the light guns impacts light sensors that communicate with a computer and also directly light display lights adjacent to the sensors. When a golf student, with the aid of a pro, achieves a swing that appears right for him, the computer may be set to lock in the swing paths as a pre-chosen path. On the subsequent swings, the computer, which is an integral part of the device, may activate an alarm such as a flashing red light when the swing deviates too much from the pre-chosen paths. This real time swing comparison causes the golfer to interrupt a non-standard or not pre-chosen swing to reinforce his learning of only a standard swing. Note the pre-chosen path would be a standard swing for the individual golfer.

A pressure sensitive pad with multiple sensors and with indicator lights allows the golf student to lock in the computer the chosen foot location. With this unit, the computer may also indicate weight shift. The implicit assumption here is that controlling head movement, leg movement, and arm movement and body movement leads to a reproducible swing. Computer analysis of the three separate paths allow computer "instruction" of the individual golfer.

We have examined the following patents:

| Pat No. | Date | Inventor |
|---|---|---|
| 4,304,406 | 12/8/81 | J. I. Cromarty |
| 4,254,956 | 3/10/81 | T. L. Rosnak |
| 3,601,408 | 8/24/71 | U. K. Wright |
| 4,327,918 | 4/4/82 | D. B. Foster |
| 4,137,566 | 1/30/79 | S. L. Haas et al |
| 4,858,934 | 8/22/89 | R. B. Ladick et al |
| 4,451,043 | 5/29/84 | Koji Ogawa et al |

All of these patents are intended to improve a players golf swing but use a different approach than our present device.

SUMMARY OF THE INVENTION

Using a first battery powered light gun attached to the users head; a second similar gun attached to the forearm and a third attached to the upper part of the leg and a base and upright panels containing light sensors and display lights communicating with a properly programmed computer a light path formed by each light gun may be illuminated and saved. When a desired swing is achieved this swing path or light path is saved and thereafter illuminated as a pre-chosen path for a particular golfer. The computer may be programmed to activate an alarm or halt light (which may simply be a flashing red light) when subsequent swings produce a light path deviating from the pre-chosen path.

A pressure sensitive pad with multiple sensors allows the user to determine proper foot location and lock it in the computer so that on subsequent usage the proper foot location may be indicated in some manner, such as a green light.

With inputs from pressure sensors and light sensors, the computer may analyze each swing subsequent to locking in pre-chosen swing and proper foot location. For example speed of backswing and relative time of shifting of weight could be indicated as a print-out even if each swing were within allowable limit of pre-chose swing.

DETAILED DESCRIPTION OF THE INVENTION

Figure 1:
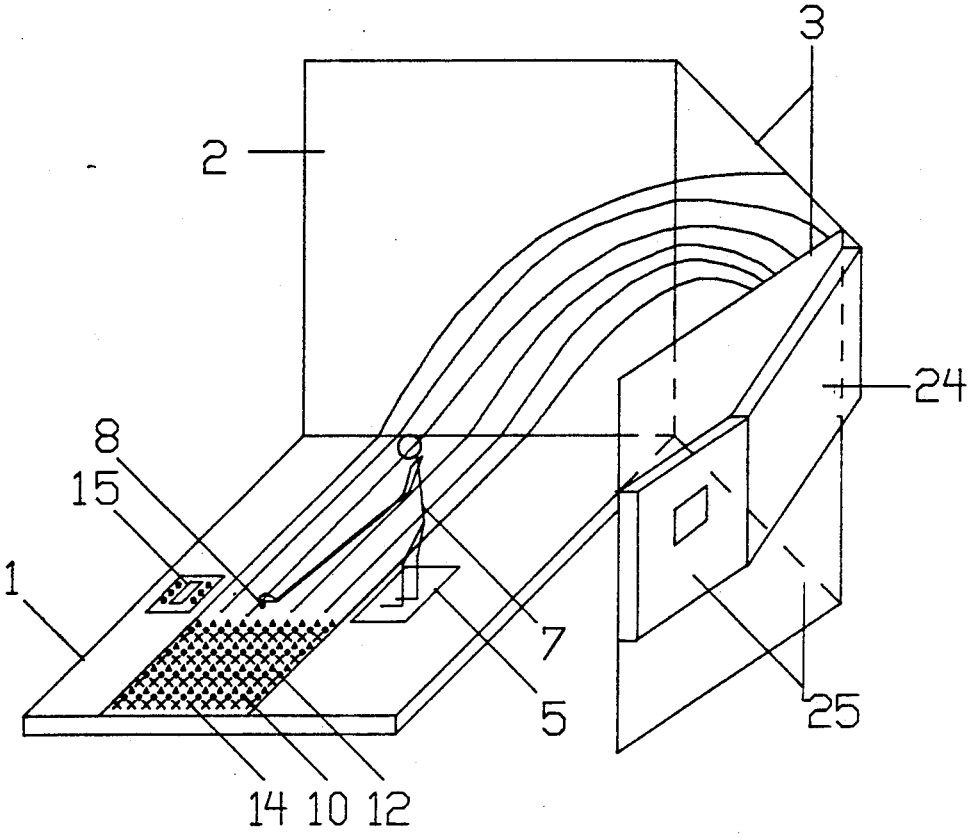
FIG. 1 shows a three dimensional view of the equipment and location of student golfer during equipment use.

The invention may best be described from the drawings. Consider first FIG. 1, base panel 1 is hinged at one end to side panel 2 which is hinged on one side to back panel 3. Back panel 3 could be a single panel but a two segment hinged panel is preferred. With proper sizing, these panels may be folded together for easy transportation.

In use golfer 7 stands on pressure sensitive pad 5. Multiple sensors in this pad communicate through a wiring channel 24 which is on the back of each panel to computer 25. Then a desired foot placement is determined and this location is set in the computer 25 and the computer activates a green light 16, FIG. 2 on instruction panel 15. For later analysis, the weight pattern for each foot is saved in the computer and the program is such that weight shift timing may be compared to timing when forearm light pattern indicates proper club head location for the weight shift to occur. This may lead to computer print-out such as "Weight Shift is O.K."

Figure 3:
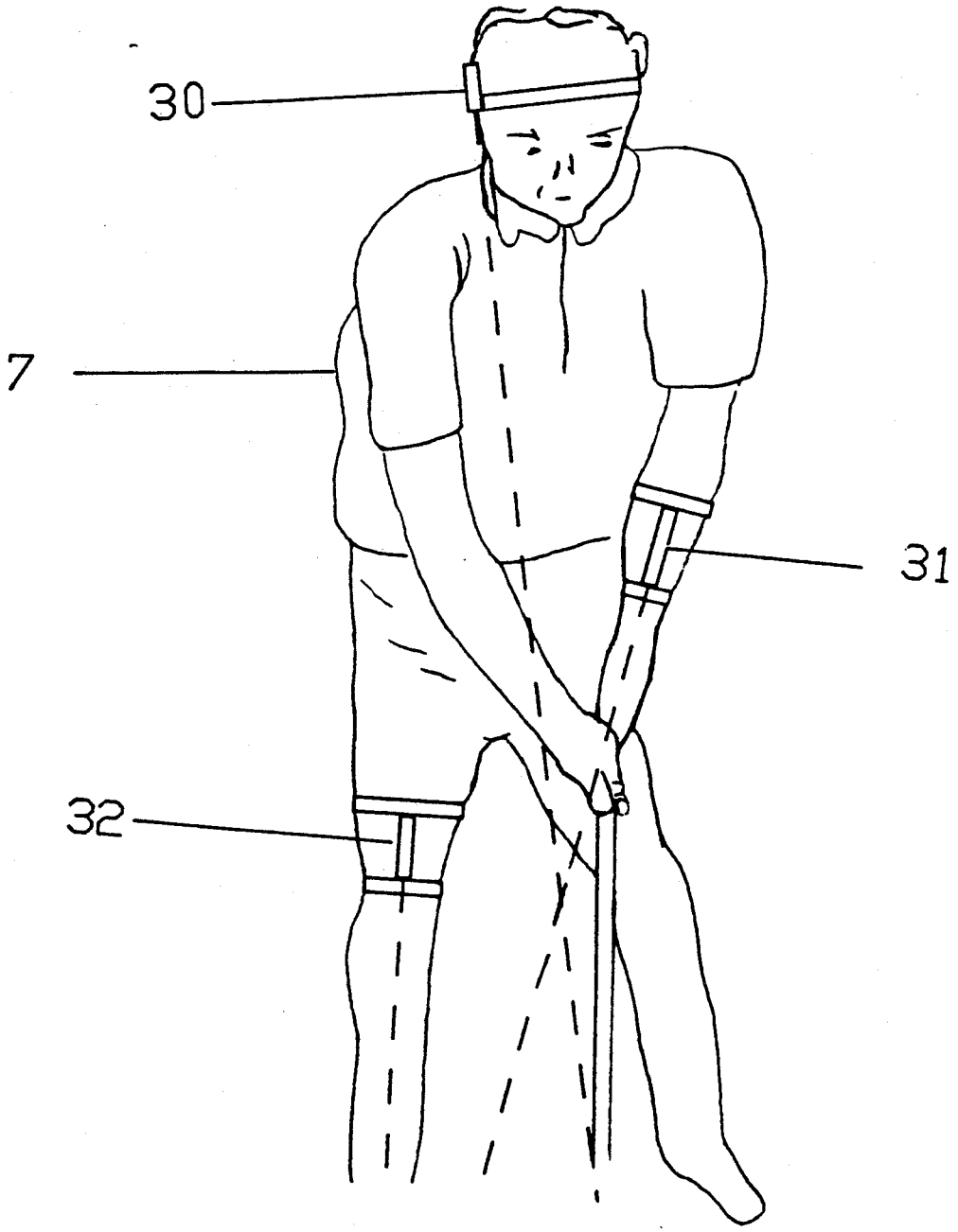
FIG. 3 indicates placement of light guns on student golfers body.

In use as golfer 7 moves club head 8 the light path from light gun 30, FIG. 3, indicating head movement, and light path from light gun 31, FIG. 3, indicating arm movement and light path from light gun 32, FIG. 3, indicating leg movement will contact sensors 10 and red lights 14 and/or green lights 12 light up according to the program in computer 25. Normally after the standard a pre-chosen path is locked in the computer and green lights 12 are activated to show proper path and red lights 14 come on with an out-of-standard path swing. An audible alarm 23 included in instruction panel 15 may also be used.

Figure 2:
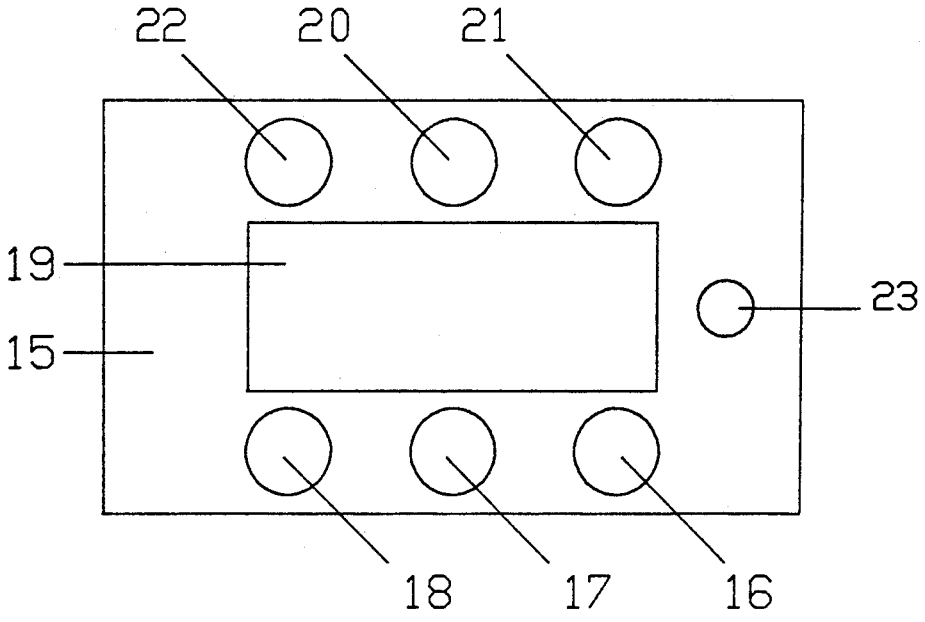
FIG. 2 shows more detail of the golfer instruction panel.

FIG. 2 shows golfer instruction panel 15 in more detail. Green light 16 indicates proper foot placement. Light 17 goes from green to red if head movement is out of standard. Light 18 changes from green to red if backswing speed is out of standard and similarly light 20 changes from green to red if downswing speed is out of standard while halt light 21 flashes red if backswing path is out of standard or pre-chosen path. Downswing halt light 22 also flashes red when out of standard or pre-chosen path occurs. Standard or pre-chosen paths are determined as "correct" for each individual golfer, usually with the aid of an instructor. Pre-chosen or standard are locked in the computer and allowable variations are built in the computer golf training program. Read out 19 prints out brief analysis on command after each swing. Analysis relates head movement, weight shift and swing light path.

In FIG. 3 we show student golfer 7 with light gun 30 properly held in place with headband; a second light gun 31 held in place on a forearm and third light gun 32 held in place on the upper leg position. In each case, proper light path to strike light sensors 10, FIG. 1, are shown.

FIG. 1

1=base panel
2=side panel
3=back panel
5=pressure sensitive pad with multiple sensors
7=golfer
8=ball on tee
10=light sensors
12=red display lights
14=green display lights
15=golfer instruction panel
24=wiring channel
25=computer

FIG. 2

15=golfer instruction panel
16=foot placement
17=head placement
18=backswing speed
19=readout
20=downswing speed
21=backswing path halt light
22=downswing path halt light
23=audible alarm

FIG. 3

30=light gun on head band
31=light gun on forearm
32=light gun on upper leg

What is claimed is:

1. A repeatable golf swing teaching device comprising:

a) a base platform, a vertical side panel and vertical back panel;

b) a pressure sensitive pad containing multiple pressure sensors on said base platform;

c) multiple sensor means and multiple green and multiple red display lights in a range of swing paths in said base platform, said vertical panel and said back panel;

d) a computer communicating with said multiple sensor means and said multiple display lights in said base platform, said vertical side panel and said vertical back panel;

e) a first form fitting battery powered light gun that may be snugly fitted to a golf student's head in a reproducible manner;

f) a second form fitting battery powered light gun that may be fitted on said golf student's left forearm in a reproducible manner;

g) a third form fitting light gun that may be reproducibly fitted around said golf students right upper leg;

h) a computer that communicates with said multiple sensor means, and said multiple pressure sensors and said multiple display lights and acts to:

1) light a red light in said pressure sensitive pad if signals received from said multiple pressure sensors differ from a previously chosen pattern;

2) light a portion of said multiple red display lights indicating light path of incident light from said first form fitting powered light gun, said second light gun and said third light gun as said golf student swings at a ball;

3) record swing path of each swing and to activate an alarm if said swing path differs markedly from a pre-chosen swing path;

4) activate a portion of said multiple green display lights to form said pre-chosen swing paths when a save and permanent display command is entered.

2. A repeatable golf swing teaching device as in claim 1 further comprising a computer output indicating elapsed time from start of a backswing to impact on a golf ball.

3. A repeatable golf swing teaching device as in claim 1 further comprising computer output of analysis of each golf swing as compared to said pre-chosen swing.

4. A repeatable golf swing teaching device as in claim 1 further comprising computer output indicating deviation from a standard of weight shift of said golf student during a swing.

* * * * *